US008959707B2

(12) United States Patent
Maeda et al.

(10) Patent No.: US 8,959,707 B2
(45) Date of Patent: Feb. 24, 2015

(54) VACUUM CLEANER

(75) Inventors: Tsuyoshi Maeda, Tokyo (JP); Sota Komae, Tokyo (JP); Junichiro Hoshizaki, Tokyo (JP); Tomoo Kobayashi, Saitama (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 351 days.

(21) Appl. No.: 13/508,232

(22) PCT Filed: Nov. 4, 2010

(86) PCT No.: PCT/JP2010/006484

§ 371 (c)(1),
(2), (4) Date: May 4, 2012

(87) PCT Pub. No.: WO2011/055538

PCT Pub. Date: May 12, 2011

(65) Prior Publication Data

US 2012/0216368 A1 Aug. 30, 2012

(30) Foreign Application Priority Data

Nov. 6, 2009 (JP) ..... 2009-254915

(51) Int. Cl.
*A47L 9/10* (2006.01)
*A47L 5/00* (2006.01)
(Continued)

(52) U.S. Cl.
CPC ..... *A47L 9/16* (2013.01); *A47L 9/1625* (2013.01); *A47L 9/1666* (2013.01); *A47L 9/1683* (2013.01); *B04C 5/04* (2013.01); *B04C 5/08* (2013.01); *B04C 5/13* (2013.01); *B04C 5/26* (2013.01)
USPC ..... 15/353; 15/347

(58) Field of Classification Search
USPC ..... 15/353, 347, 352; 55/320, 337, 418, 55/419, 419.1–419.3, 474, 479, 518
See application file for complete search history.

(56) References Cited

U.S. PATENT DOCUMENTS 6,042,628 A * 3/2000 Nishikiori et al. ..... 55/337
6,896,720 B1 5/2005 Arnold et al.
(Continued)

FOREIGN PATENT DOCUMENTS

CN 1296801 A 5/2001
CN 201131706 Y 10/2008
(Continued)

OTHER PUBLICATIONS

Taiwanese Office Action dated Mar. 25, 2013, issued in corresponding Taiwanese Patent Application No. 99138086, and Partial English language translation of Office Action. (12 pages).
(Continued)

*Primary Examiner* — Dung Van Nguyen
(74) *Attorney, Agent, or Firm* — Buchanan Ingersoll & Rooney PC

(57) ABSTRACT

A vacuum cleaner including a suction port body, a motor-driven blower, and a cyclone part that is disposed between the suction port body and the motor-driven blower and is provided with an inflow port, a swirl chamber, and a discharge port body. The side surface of the discharge port body is composed of a cylindrical mesh and a conical mesh. The side wall of the swirl chamber is composed of a cylindrical part and a conical part. The vacuum cleaner further includes a zero-order opening formed by opening a part of the cylindrical part, a first-order opening formed by opening a part of the conical part, a zero-order dust case communicating with the swirl chamber via the zero-order opening, and a first-order dust case communicating with the swirl chamber via the first-order opening.

10 Claims, 19 Drawing Sheets

(51) Int. Cl.

| | |
|---|---|
| ***A47L 9/16*** | (2006.01) |
| ***B04C 5/04*** | (2006.01) |
| ***B04C 5/08*** | (2006.01) |
| ***B04C 5/13*** | (2006.01) |
| ***B04C 5/26*** | (2006.01) |

(56) References Cited

U.S. PATENT DOCUMENTS

| | | | | |
|---|---|---|---|---|
| 7,273,506 | B2 * | 9/2007 | Oh et al. | 55/343 |
| 7,883,560 | B2 * | 2/2011 | Ni | 55/343 |
| 2002/0020154 | A1 | 2/2002 | Yang | |
| 2002/0095741 | A1 | 7/2002 | Inoue et al. | |
| 2006/0150587 | A1 | 7/2006 | Hong et al. | |
| 2009/0199359 | A1 * | 8/2009 | Hyun et al. | 15/347 |

FOREIGN PATENT DOCUMENTS

| | | | |
|---|---|---|---|
| EP | 0018197 | A1 | 10/1980 |
| EP | 0 841 085 | A1 | 5/1998 |
| EP | 1 774 891 | A2 | 4/2007 |
| EP | 1 857 032 | A2 | 11/2007 |
| GB | 2418162 | A | 3/2006 |
| GB | 2469057 | A | 6/2010 |
| JP | 9-164344 | A | 6/1997 |
| JP | 2002-503541 | A | 2/2002 |
| JP | 2005-349099 | A | 12/2005 |
| JP | 2006-187587 | A | 7/2006 |
| WO | WO 99/42198 | A1 | 8/1999 |
| WO | 2008/054046 | A1 | 5/2008 |

OTHER PUBLICATIONS

International Search Report (PCT/ISA/210) issued on Dec. 7, 2010, by the Japanese Patent Office as the International Searching Authority for International Application No. PCT/JP2010/006484.

Written Opinion (PCT/ISA/237) issued on Dec. 7, 2010, by the Japanese Patent Office as the International Searching Authority for International Application No. PCT/JP2010/006484.

Japanese Office Action dated Nov. 22, 2012 with English language translation.

Office Action issued on Oct. 28, 2013, by the GB Patent Office in corresponding GB Application No. 1207681.6. (2 pages).

Office Action dated Jul. 24, 2012, Issued in corresponding Japanese Patent Application No. 2009-254915, and a partial English Translation thereof. (3 pages).

Office Action (Notification of the First Office Action) issued on Jan. 24, 2014, by the Chinese Patent Office in corresponding Chinese Patent Application No. 201080056293.5, and an English Translation of the Office Action. (16 pages).

Office Action (First Examination Report) issued on Nov. 6, 2013, by the Intellectual Property Office of New Zealand in corresponding New Zealand Patent Application No. 616818.

Great Britain Office Action dated Jan. 16, 2014, issued in corresponding Great Britain Application No. 1207681.6 (3 pgs.).

Great Britain Office Action dated Jan. 16, 2014, issued in corresponding Great Britain Application No. 1323069.3 (5 pgs.).

Office Action issued on May 27, 2014, by the Great Britain Patent Office in corresponding Great Britain Patent Application No. 1323069.3. (3 pages).

Chinese Second Office Action dated Jul. 28, 2014 issued in the corresponding Chinese Patent Application No. 2010800562935 and English language translation (13 pages).

* cited by examiner

VACUUM CLEANER

TECHNICAL FIELD

The present invention relates to a vacuum cleaner and, more particularly, to a vacuum cleaner provided with a cyclone dust separator.

BACKGROUND ART

Conventionally, as a vacuum cleaner of this type, there has been known, for example, "a device including a housing having a means for taking a fluid containing particulates and a means for discharging the fluid having been cleaned; and a means for generating a first-order eddy current in the inflow fluid, wherein the housing includes a separation zone including a first separation chamber and a second separation chamber each of which is connected to a particulate collecting means; and a connecting means for generating a second-order eddy current in the second separation chamber, whereby particulates are separated into the first separation chamber and the second separation chamber by a difference in inertial force applied to particulates having a different weight" (for example, refer to Patent Literature 1).

CITATION LIST

Patent Literature

Patent Literature 1: National Publication of International Patent Application No. 2002-503541 (Abstract)

SUMMARY OF INVENTION

Technical Problem

In the prior art disclosed in Patent Literature 1, since an outflow port for discharging air in the housing (a swirl chamber in which particulates are swirled) is open in the axial direction with respect to the housing, the air current flows into the swirl chamber with a high axial speed, so that a sufficient swirling force cannot be given to both of the dust separated in the first separation chamber and the dust separated in the second separation chamber. Therefore, there arises a problem that the centrifugal force is insufficient and he dust collecting performance is low.

The present invention has been made to solve the above-described problem, and accordingly an object thereof is to provide a vacuum cleaner in which, when dust is separated at two places in a swirl chamber, a sufficient swirling force is given to both of the dust separated at one place and the dust separated at the other place, whereby the dust collecting performance can be improved.

Means for Solving the Problems

A vacuum cleaner of the present invention includes a suction port body for sucking dust-containing air from the outside, a motor-driven blower for generating suction air and a cyclone part which is disposed between the suction port body and the motor-driven blower and is provided with an inflow port, a swirl chamber, and a discharge port body so that the dust-containing air flowing in through the inflow port is swirled in the swirl chamber, and is discharged from the discharge port body after dust has been separated. The side surface of the discharge port body is composed of a substantially cylindrically-shaped cylindrical body having a plurality of pores and a substantially conically-shaped conical body having a plurality of pores, the side wall of the swirl chamber is composed of a substantially cylindrically-shaped cylindrical part and a substantially conically-shaped conical part. The vacuum cleaner further includes a first opening formed by opening a part of the cylindrical part of the swirl chamber, a second opening formed by opening a part of the conical part of the swirl chamber, a first dust case communicating with the swirl chamber via the first opening and a second dust case communicating with the swirl chamber via the second opening.

Advantageous Effect of Invention

According to the vacuum cleaner in accordance with the present invention, by employing the above-described configuration, dust can be centrifugally separated with high efficiency and can be collected in the first dust case and the second dust case.

DESCRIPTION OF EMBODIMENTS

First embodiment

A first embodiment of the present invention will now be described with reference to the accompanying drawings.

Figure 1:
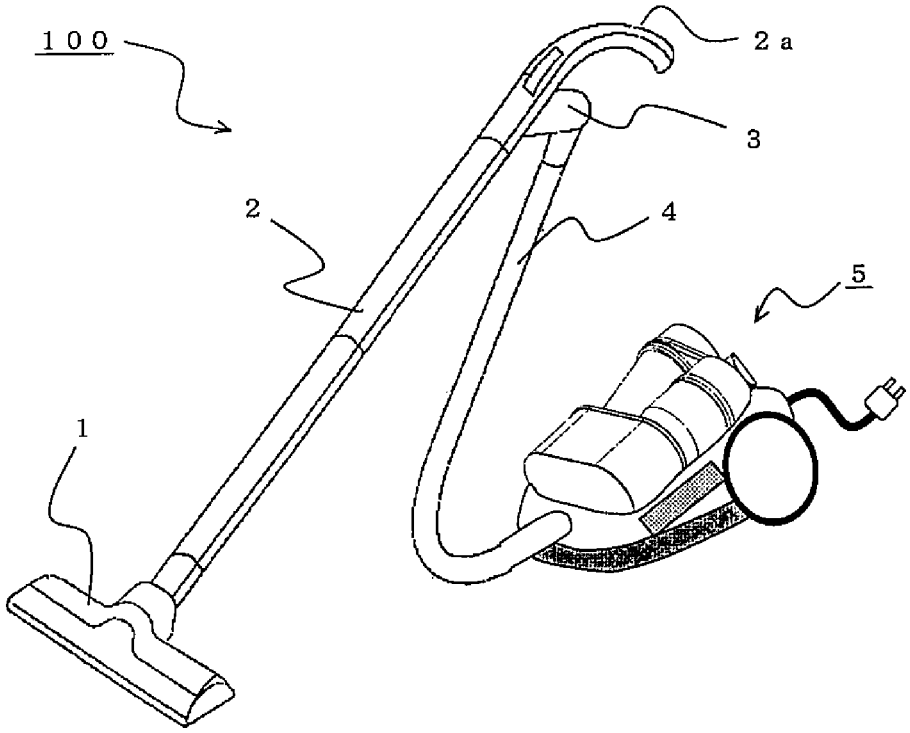
FIG. 1 is an appearance view showing a general configuration of a vacuum cleaner in accordance with the present invention.

FIG. 1 is an appearance view showing a general configuration of a vacuum cleaner in accordance with the present invention.

As shown in FIG. 1, a vacuum cleaner 100 includes a suction port body 1, a suction pipe 2, a connecting pipe 3, a hose 4, and a cyclone-type cleaner body 5. The suction port body 1 sucks dust on the floor surface and dust-containing air. To the outlet side of the suction port body 1, one end of the straight and cylindrically shaped suction pipe 2 is connected. On the other end of the suction pipe 2, a handle grip 2*a* is provided, and one end of the connecting pipe 3 that is somewhat bent in an intermediate portion thereof is connected to the other end of the suction pipe 2. To the other end of the connecting pipe 3, one end of the pleated hose 4 having flexibility is connected. Further, to the other end of the hose 4, the cleaner body 5 is connected. The suction port body 1, the suction pipe 2, the connecting pipe 3, and the hose 4 constitute a part of a flow passage for allowing dust-containing air to flow from the outside to the interior of the cleaner body 5.

Figure 2:
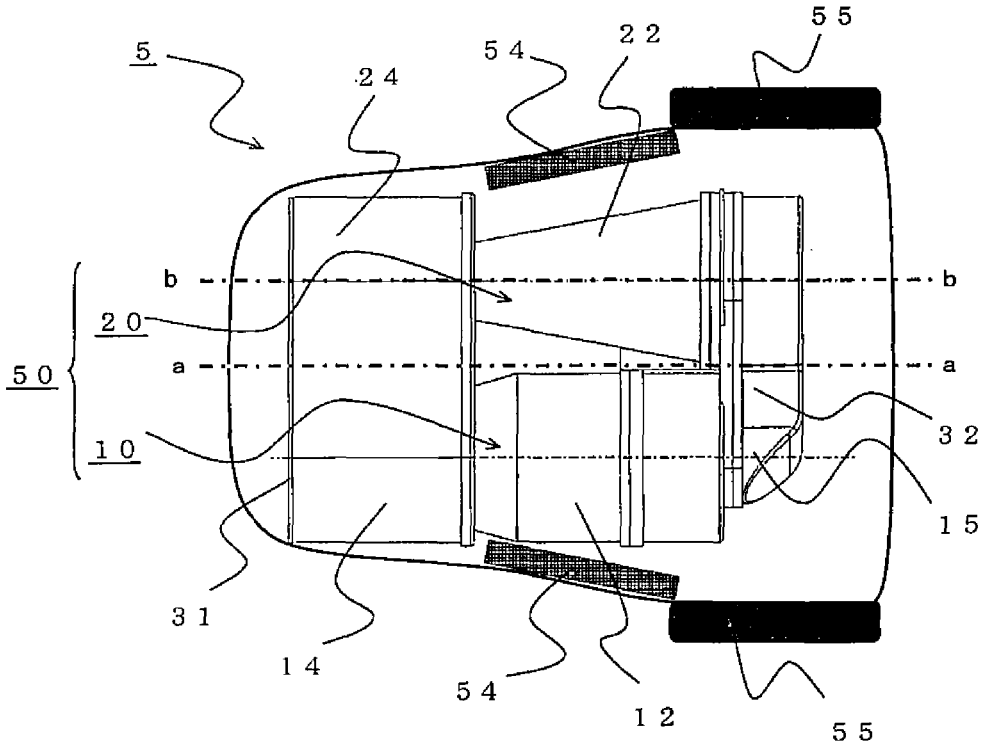
FIG. 2 is a top view of a cleaner body 5 of the vacuum cleaner shown in FIG. 1.

FIG. 2 is a top view of a cleaner body 5 of the vacuum cleaner shown in FIG. 1. Also, FIG. 3 is a sectional view taken along the line a-a of the cleaner body 5 shown in FIG. 2, and FIG. 4 is a sectional view taken along the line b-b of the cleaner body 5 shown in FIG. 2.

Figure 3:
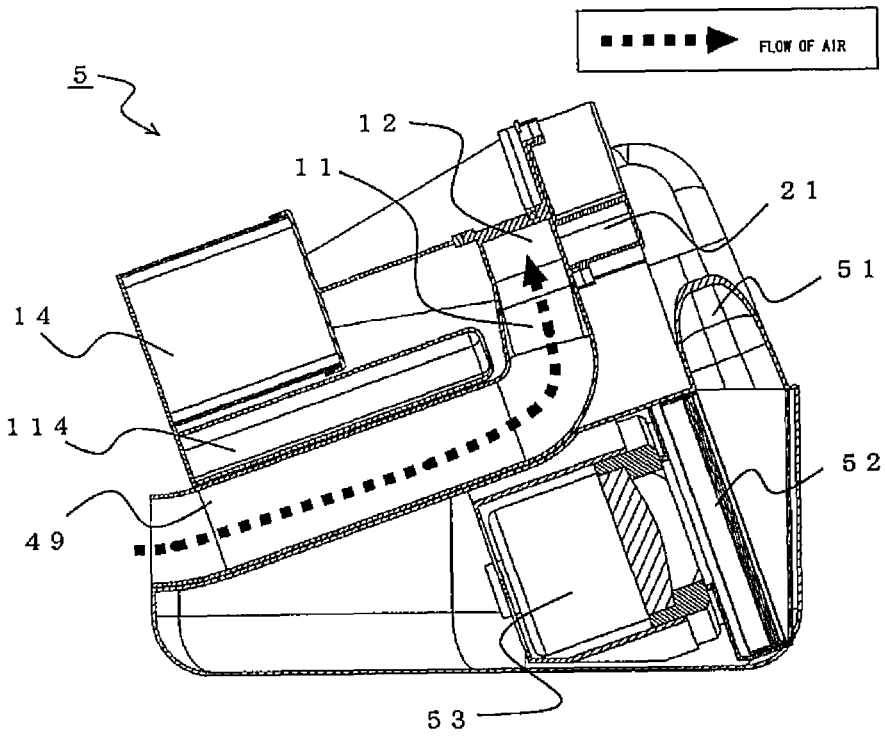
FIG. 3 is a sectional view taken along the line a-a of the cleaner body 5 shown in FIG. 2.
Figure 4:
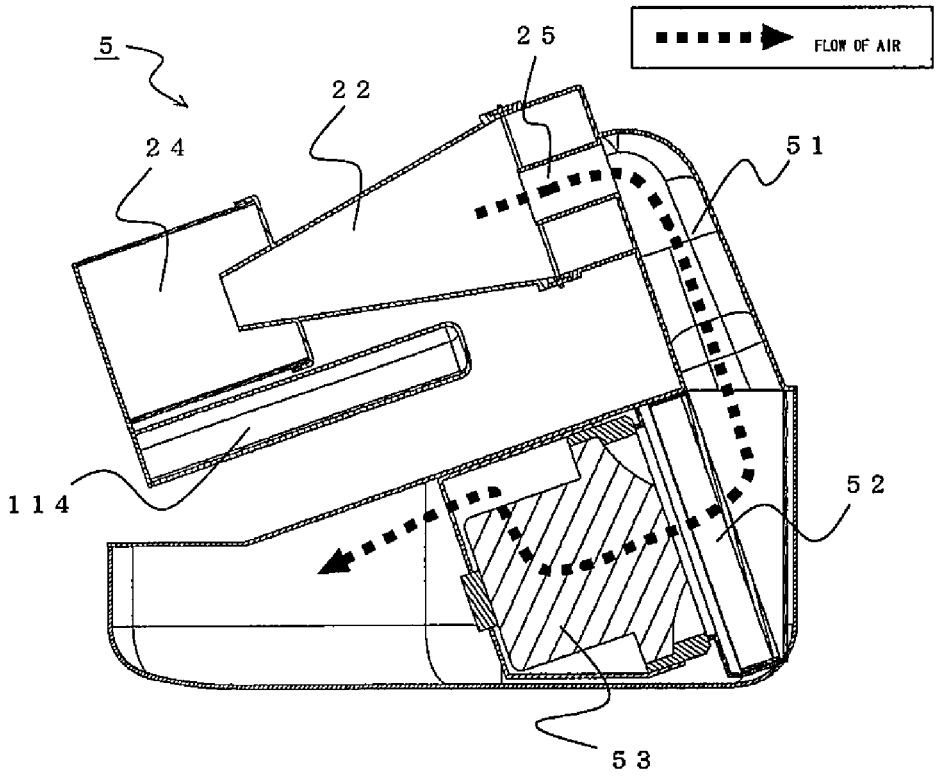
FIG. 4 is a sectional view taken along the line b-b of the cleaner body 5 shown in FIG. 2.

As shown in FIGS. 2 to 4, the cleaner body 5 of the vacuum cleaner 100 includes a suction air passage 49, a cyclone dust collector 50, a discharge air passage 51, a filter 52, a motor-driven blower 53, and discharge ports 54. Besides, the cleaner body 5 includes wheels 55 and a cord reel part, not shown, that are disposed in the rear portion thereof. The cyclone dust collector 50 includes a cyclone part 10 and a second cyclone part 20 disposed in parallel with the cyclone part 10.

The cyclone part 10 includes an inflow port 11, a swirl chamber 12, a zero-order dust case 114, a first-order dust case 14, and a discharge port body 15. The second cyclone part 20 includes a second inflow port 21, a second swirl chamber 22, a second-order dust case 24, and a second discharge port 25. The first-order dust case 14 and the second-order dust case 24 are formed as one case component. Also, the zero-order dust case 114, the first-order dust case 14, and the second-order dust case 24 are configured so that the openings in the lower end portions thereof are opened and closed by a dust case lid 31.

In the upper portion of the cyclone part 10, there is provided an intermediate air passage 32 for allowing the discharge port body 15 and the second inflow port 21 to communicate with each other. Further, in the upper portion of the second cyclone part 20, there is provided the discharge air passage 51 continuous with the second discharge port 25. Thereby, the configuration is made such that the air flowing from the outside into the cleaner body 5 passes through the suction air passage 49, the inflow port 11, the swirl chamber 12, the discharge port body 15, the intermediate air passage 32, the second inflow port 21, the second swirl chamber 22, and the second discharge port 25 in that order, and thereafter is discharged into the cleaner body 5 through a discharge passage consisting of the discharge air passage 51, the filter 52, the motor-driven blower 53, and the discharge ports 54.

Figure 5:
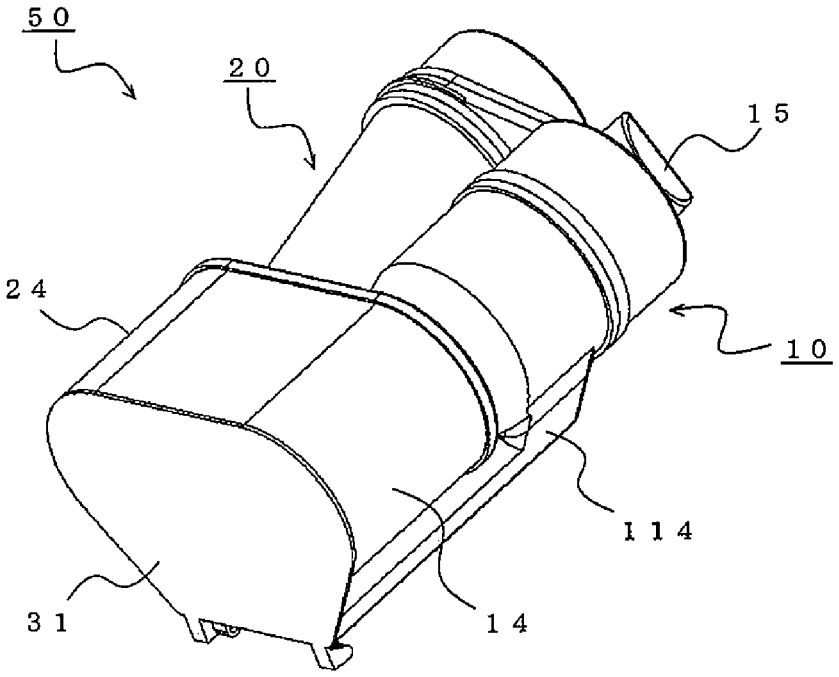
FIG. 5 is a perspective view showing the appearance of the cyclone dust collector 50 that is the essential portion of the cleaner body 5 of the vacuum cleaner shown in FIG. 1.
Figure 6:
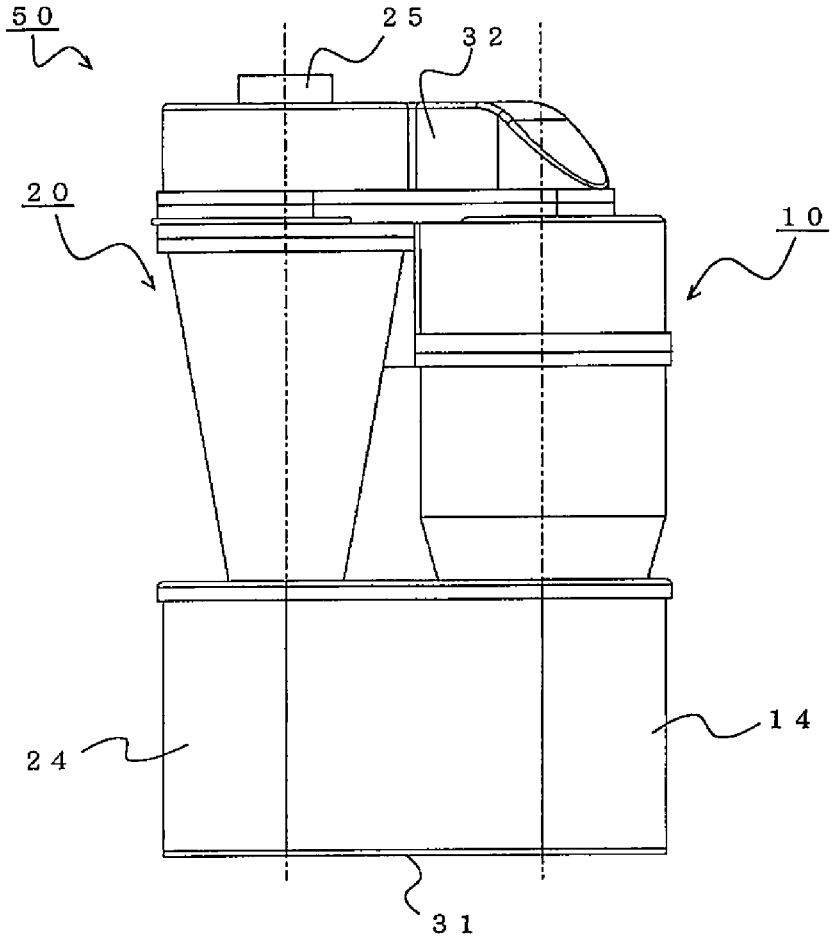
FIG. 6 is a front view of the cyclone dust collector 50 of a vacuum cleaner in accordance with the present invention.
Figure 7:
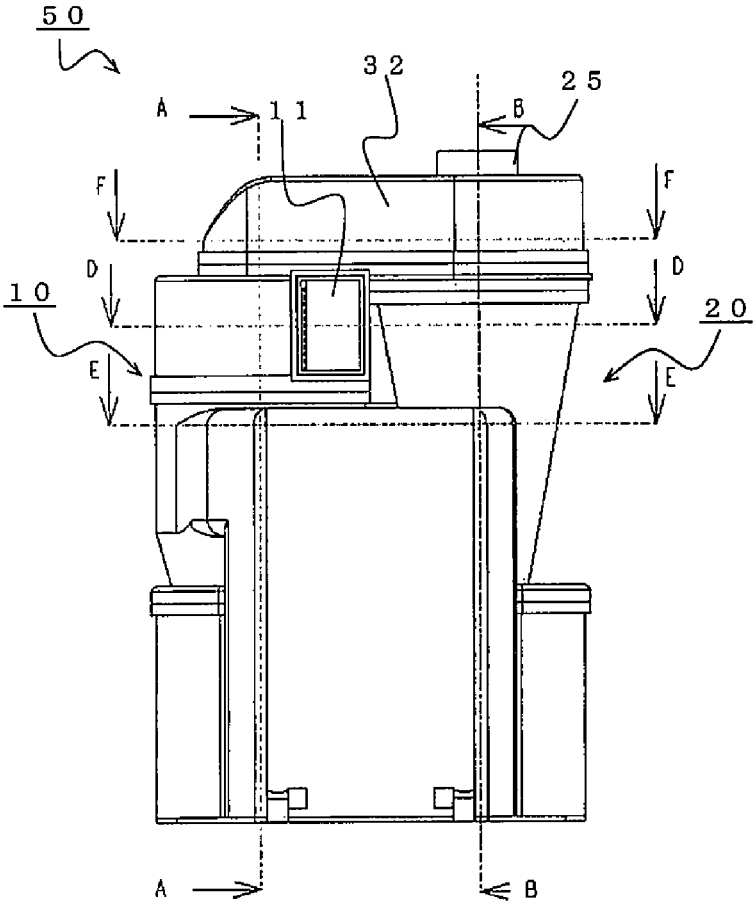
FIG. 7 is a rear view of the cyclone dust collector 50 of a vacuum cleaner in accordance with the present invention.
Figure 8:
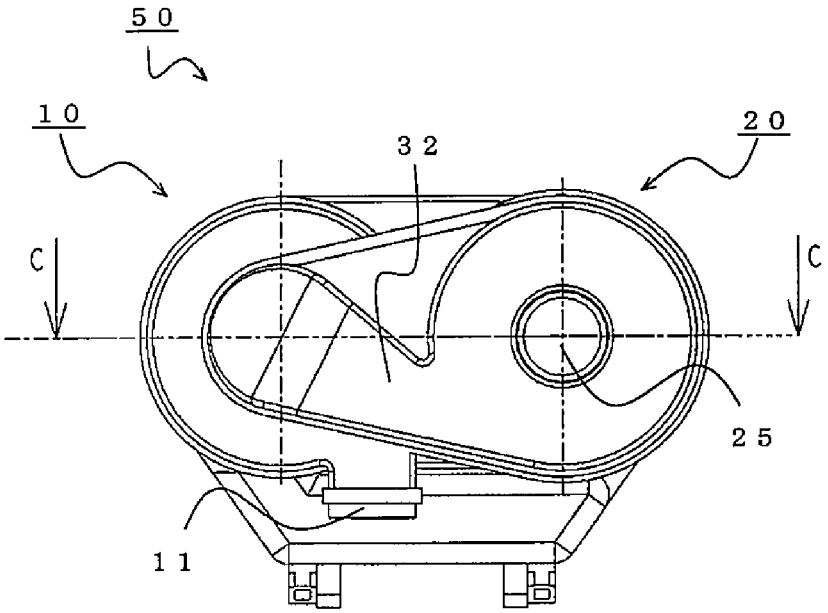
FIG. 8 is a plan view of the cyclone dust collector 50 of a vacuum cleaner in accordance with the present invention.
Figure 9:
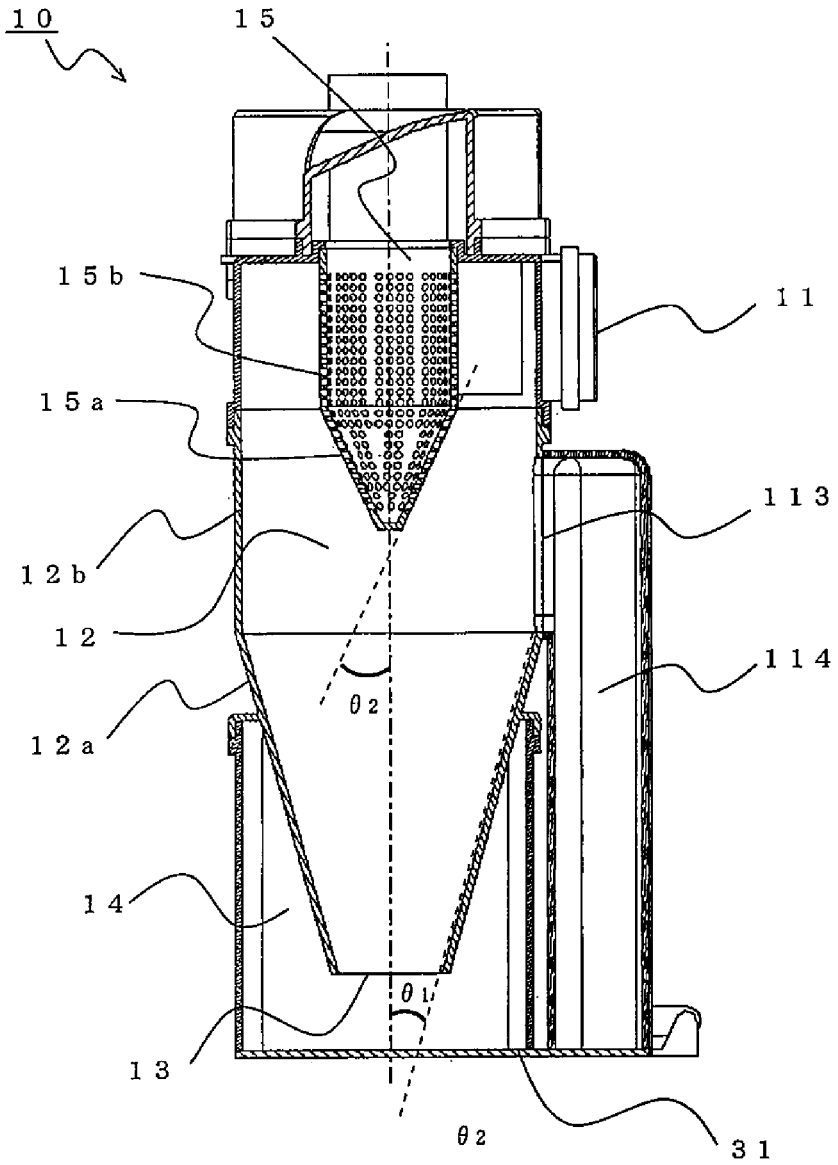
FIG. 9 is a sectional view taken along the line A-A of FIG. 7 in the first embodiment.
Figure 10:
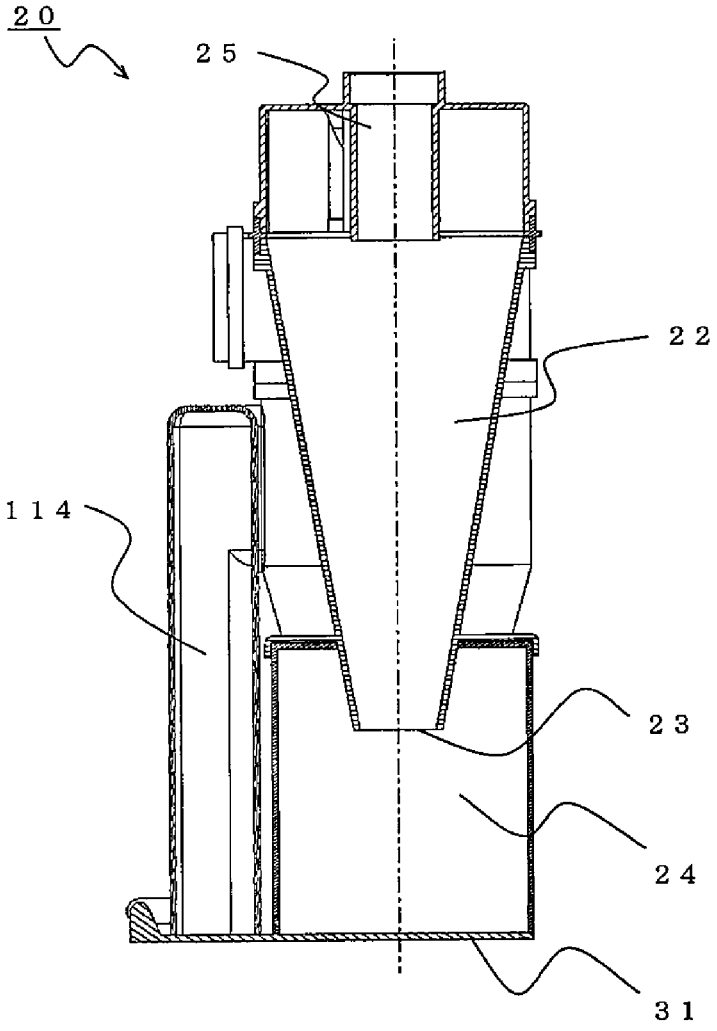
FIG. 10 is a sectional view taken along the line B-B of FIG. 7 in the first embodiment.
Figure 11:
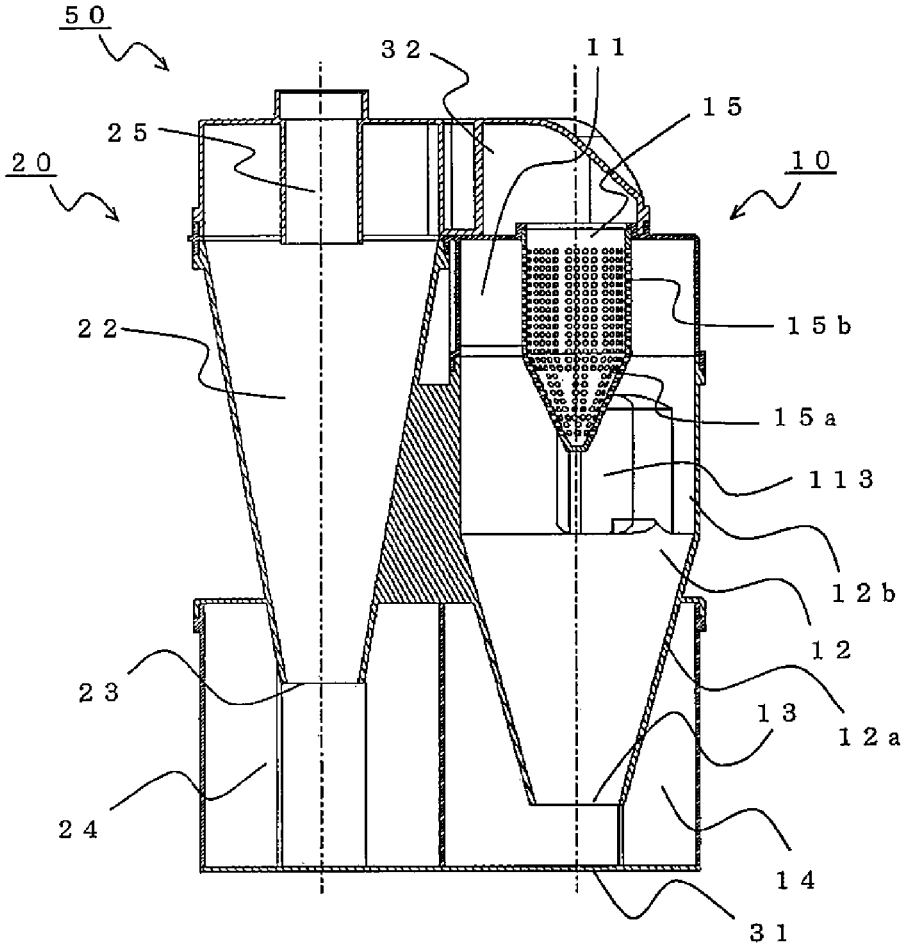
FIG. 11 is a sectional view taken along the line C-C of FIG. 8 in the first embodiment.
Figure 12:
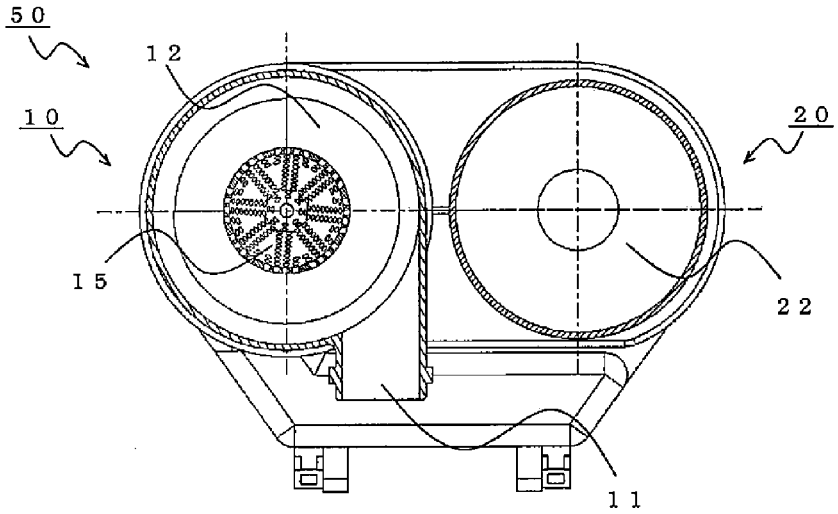
FIG. 12 is a sectional view taken along the line D-D of FIG. 7 in the first embodiment.
Figure 13:
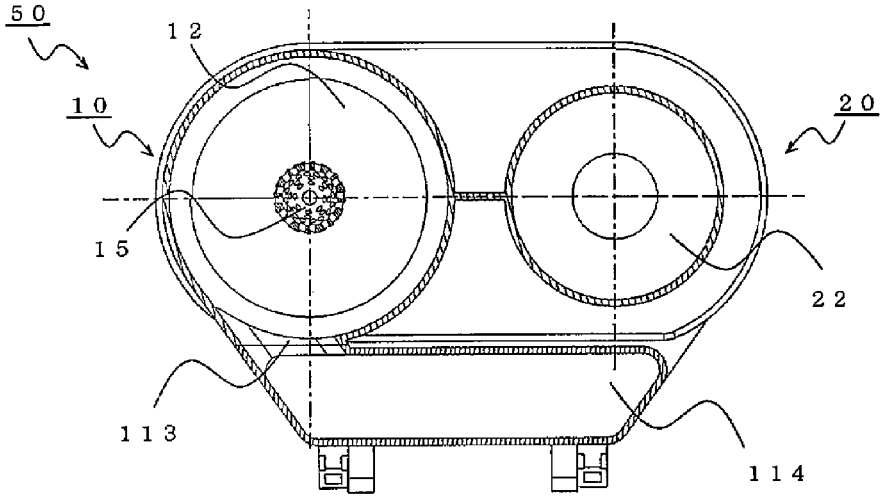
FIG. 13 is a sectional view taken along the line E-E of FIG. 7 in the first embodiment.
Figure 14:
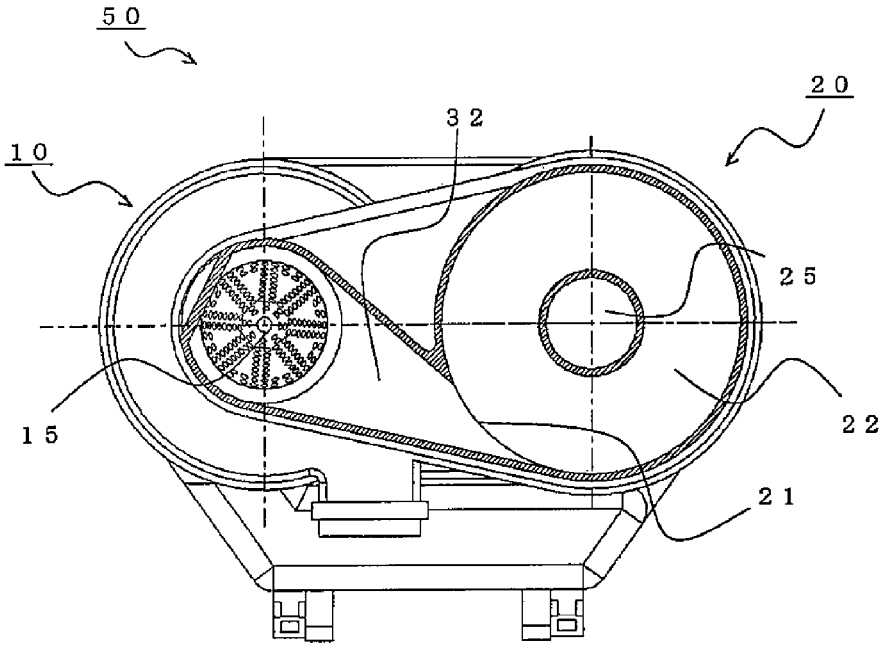
FIG. 14 is a sectional view taken along the line F-F of FIG. 7 in the first embodiment.
Figure 15:
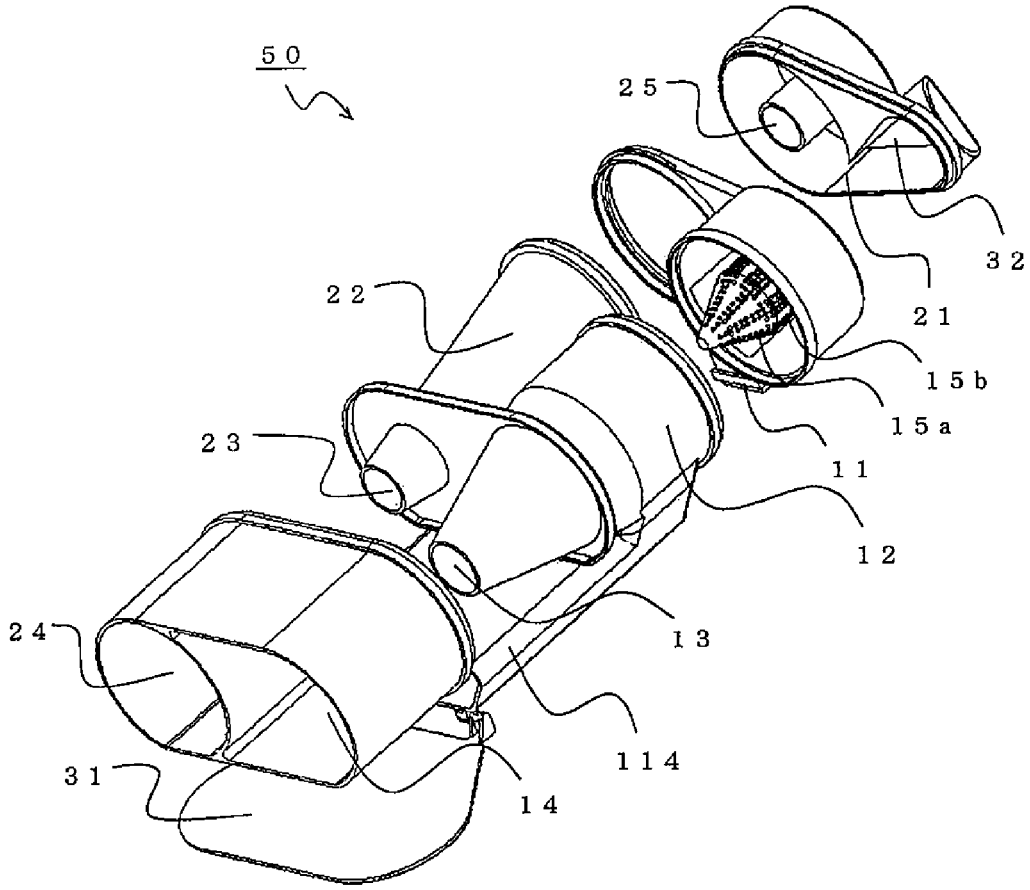
FIG. 15 is an exploded perspective view of the cyclone dust collector 50 in the first embodiment.

FIG. 5 is a perspective view showing the appearance of the cyclone dust collector 50 that is the essential portion of the cleaner body 5 of the vacuum cleaner shown in FIG. 1. FIG. 6 is a front view of the cyclone dust collector 50, FIG. 7 is a rear view of the cyclone dust collector 50, and FIG. 8 is a plan view of the cyclone dust collector 50. FIG. 9 is a sectional view taken along the line A-A of FIG. 7, FIG. 10 is a sectional view taken along the line B-B of FIG. 7, FIG. 11 is a sectional view taken along the line C-C of FIG. 8, FIG. 12 is a sectional view taken along the line D-D of FIG. 7, FIG. 13 is a sectional view taken along the line E-E of FIG. 7, and FIG. 14 is a sectional view taken along the line F-F of FIG. 7. FIG. 15 is an exploded perspective view of the cyclone dust collector 50.

Next, the configuration of the cyclone dust collector 50 is explained with reference to FIGS. 5 to 15.

As described above, the cyclone dust collector 50 of the vacuum cleaner 100 includes the cyclone part 10 and the second cyclone part 20 disposed in parallel with the cyclone part 10. Also, the intermediate air passage 32, which is provided in the upper portion of the cyclone part 10, is continuously connected to the second inflow port 21 provided in the upper portion of the second cyclone part 20. The second cyclone part 20 has dust separating performance equivalent to or higher than the performance of the cyclone part 10.

As described above, the second cyclone part 20 is disposed at the downstream position of the cyclone part 10. Therefore, the second cyclone part 20 collects dust that has not been collected completely by the cyclone part 10, so that the air discharged from the vacuum cleaner can further be purified.

The cyclone part 10 includes the inflow port 11 for taking dust-containing air from the suction air passage 49, and the swirl chamber 12 in which the dust-containing air introduced through the inflow port 11 is swirled by connecting the inflow port 11 approximately in the tangential direction, and is configured so that the suction air flowing into the swirl chamber 12 through the inflow port 11 is swirled to separate dust, and thereafter the suction air is discharged from the discharge port body 15. The side wall of the discharge port body 15 is composed of a substantially cylindrically-shaped cylindrical mesh 15*b* having a large number of micropores, and a substantially conically-shaped conical mesh 15*a* having a large number of micropores. Also, the side wall of the swirl chamber 12 is composed of a substantially cylindrically-shaped cylindrical part 12*b*, and a substantially conically-shaped conical part 12*a*. The cyclone part 10 includes a zero-order opening 113 formed by opening a part of the cylindrical part 12*b*, a first-order opening 13 formed by opening a part of the conical part 12*a*, the zero-order dust case 114 communicating with the swirl chamber 12 via the zero-order opening 113, and the first-order dust case 14 communicating with the swirl chamber 12 via the first-order opening 13. The micropores in the conical mesh 15*a* and the cylindrical mesh 15*b* consist of pores for allowing the interior and the exterior of the wall surface having a thickness to communicate with each other.

The zero-order opening 113 corresponds to a first opening of the present invention, and the zero-order dust case 114 corresponds to a first dust case of the present invention. The cylindrical mesh 15*b*, the conical mesh 15*a*, the first-order opening 13, and the first-order dust case 14 respectively correspond to a cylindrical body, a conical body, a second opening, and a second dust case of the present invention.

Herein, the outline of the operation of the cyclone part 10 is described.

When dust-containing air is taken in the cyclone part 10 through the inflow port 11 after passing through the suction air passage 49, the dust-containing air turns to a swirling air current because of flowing into the cyclone part 10 substantially in the horizontal direction along the side wall of the swirl chamber 12, and flows downward on account of the passage structure of the cyclone part 10 and the gravity of the dust-containing air while forming a forced eddy zone in the vicinity of the central axis and a quasi-free eddy zone on the outer periphery side. At this time, since a centrifugal force acts on the dust, dust having a relatively large size and specific gravity, such as hair, candy bags, and sand (relatively large sand), (hereinafter, referred to as "dust A") is pushed against the inner wall of the swirl chamber 12 and is separated from the suction air, and is captured by and accumulated in the zero-order dust case 114 via the zero-order opening 113. The remaining dust goes downward in the swirl chamber 12 on account of the swirling current going downward. Thereby, cotton dust and fine sand dust that are light in weight, easily carried off by air current, and bulky (hereinafter, referred to as "dust B") are sent into the first-order dust case 14 via the first-order opening 13. Further, the dust B is driven off to the upside of the first-order dust case 14 by the wind pressure, and is accumulated and compressed therein. The air from which the dust A and the dust B have been removed rises along the central axis of the cylinder of the cyclone part 10, and is discharged from the discharge port body 15. The air having been discharged from the discharge port body 15 flows into the second swirl chamber 22 via the intermediate air passage 32 and the second inflow port 21 of the second cyclone part 20. The air flowing into the second swirl chamber 22 lowers while swirling, and passes through the second-order dust case 24. Thereafter, the air rises and is discharged through the second discharge port 25, and then is discharged from the cleaner body 5 through the discharge passage consisting of the discharge air passage 51, the filter 52, the motor-driven blower 53, and the discharge ports 54.

The discharge port body 15 of the cyclone part 10 is configured as described above, so that a sufficient centrifugal force can be given to both of the dust A that is swirled in a swirl zone formed by the cylindrical part 12*b* and is collected in the zero-order dust case 114 and the dust B that is swirled in a swirl zone formed by the conical part 12*a* and is collected in the first-order dust case 14. Further, a current, which is formed by the air current arriving at the lower portion of the swirl chamber 12 while being swirled, turning around, and rising in the center of the swirl chamber 12, can be taken in smoothly by the conical mesh 15*a*. Therefore, the dust collecting performance can be improved without disturbing the swirling air current. Also, the substantially conical shape of the conical mesh 15*a* has an advantage that when long thread shaped dust such as hair gets entangled with the side wall of the discharge port body 15, the entangled dust can be removed more easily by being moved along the direction toward the vertex of cone.

On the side wall of the discharge port body 15, the sum total of the opening areas of micropores of the conical mesh 15*a* is smaller than the sum total of the opening areas of micropores of the cylindrical mesh 15*b*.

Since the dust A has a large surface area and receives large air resistance as compared with the dust B, the influence of suction force in the centripetal direction is relatively small, so that even if the sum total of the opening areas of micropores of the cylindrical mesh 15*b* is increased, the influence on the dust A collecting performance is small. Therefore, by increasing the sum total of the opening areas of micropores of the cylindrical mesh 15*b*, the wind velocity of air current at the time when the air current passes through the micropores is restrained, and thereby the pressure loss can be reduced.

Also, as shown in FIG. 9, the tilt angle $\theta_1$ of the conical part 12*a* with respect to the central axis of the swirl chamber 12 is approximately equivalent to or smaller than the tilt angle $\theta_2$ of the conical mesh 15*a* with respect to the central axis of the swirl chamber 12.

By setting the tilt angles $\theta_1$ and $\theta_2$ as described above, the pressure loss is retrained, the air passage for the rising current in the center of the swirl chamber 12 is secured, and the interference between the swirling current and the rising current is prevented to eliminate the turbulence of air current without decreasing, in the conical part 12*a*, the air passage cross-sectional area of swirl air passage (air passage excluding the discharge port body 15) in the swirl chamber 12. Therefore, the dust collecting performance can be improved. Also, by preventing the distance between the wall surface of the conical part 12*a* and the conical mesh 15*a* from being decreased, the dust B swirling along the inner wall surface of the conical part 12*a* can be restrained from being sucked through the conical mesh 15*a*.

The first-order opening 13 formed in the lower portion of the swirl chamber 12 is configured so that the opening area thereof is smaller than the opening area of the zero-order opening 113.

This achieves an effect that the amount of air that passes through the first-order opening 13 and flows into the first-order dust case 14 is restrained, and the dust B arriving at the first-order dust case 14 is restrained from scattering again.

In the above-described first embodiment, explanation has been given of the configuration in which the second cyclone part 20, the filter 52, and the motor-driven blower 53 are arranged in that order at the downstream position of the cyclone part 10. However, the present invention is not limited to the configuration example of the first embodiment. For example, the configuration in which the second cyclone part 20 is absent also achieves a certain effect.

Second Embodiment

Hereunder, a second embodiment of the present invention is described with reference to FIGS. 16 to 23. In this embodiment, the same names and reference signs are used for structures that are the same as the structures explained in the first embodiment.

Figure 16:
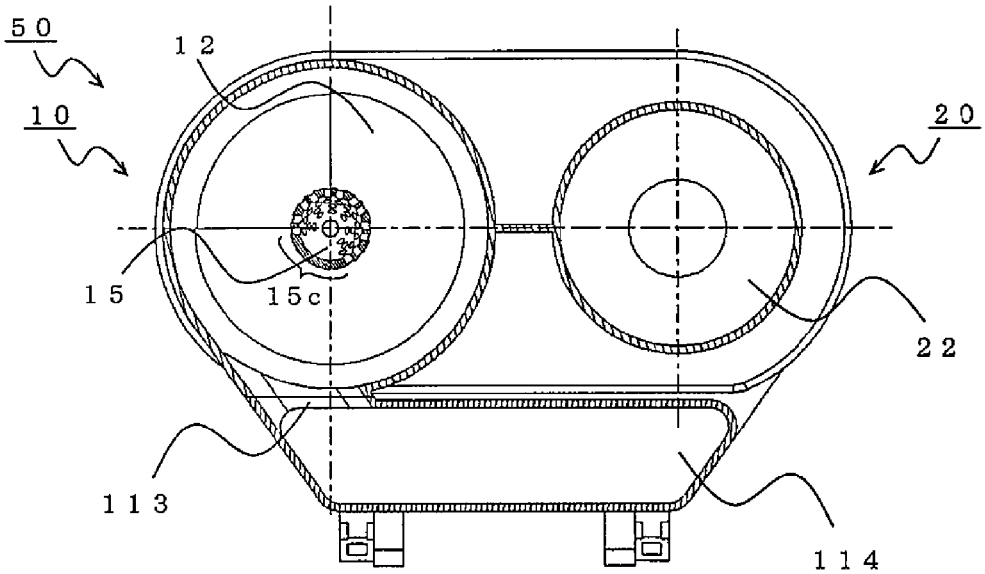
FIG. 16 is a sectional view taken along the line E-E of FIG. 7 in the second embodiment.
Figure 17:
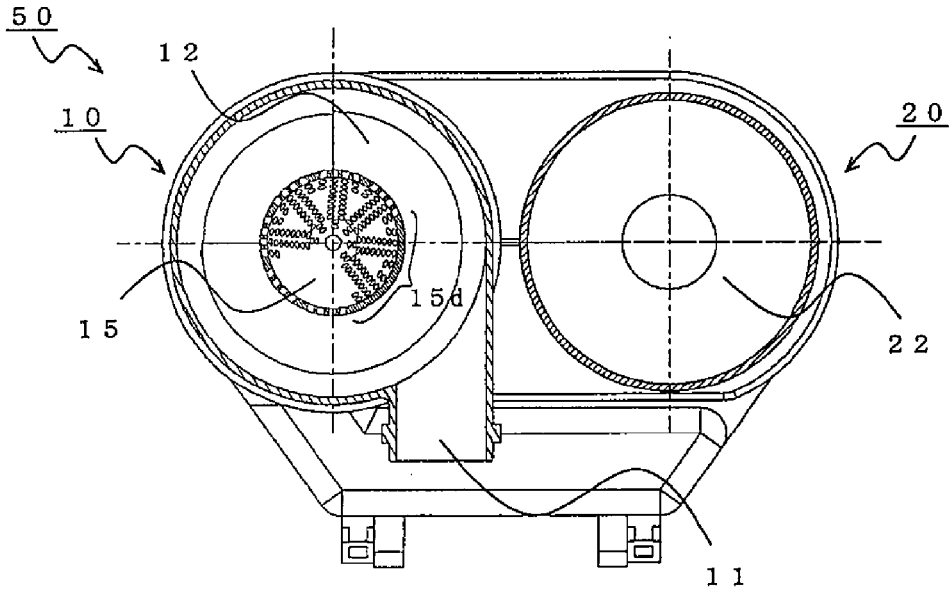
FIG. 17 is a sectional view taken along the line D-D of FIG. 7 in the second embodiment.

FIG. 16 is a sectional view taken along the line E-E of FIG. 7 in the second embodiment, and FIG. 17 is a sectional view taken along the line D-D of FIG. 7 in the second embodiment.

As shown in FIG. 16, the discharge port body 15 has a configuration such that in the conical mesh 15*a* constituting a part of the side wall of the discharge port body 15, micropores are formed in a zone excluding a part near the zero-order opening 113, for example, a portion denoted by reference sign 15*c*.

By forming micropores in the zone excluding a part 15*c* near the zero-order opening 113 in the conical mesh 15*a* as described above, the force for sucking the dust A through the micropores in the side wall of the discharge port body 15 is restrained while the axial suction force is restrained and the swirling force acting on dust is increased. Therefore, the dust A can be collected surely in the zero-order dust case 114. In contrast, in the case where the micropores are formed in the portion near the zero-order opening 113, the suction force applied through the micropores in the side wall of the discharge port body 15 acts greatly on the dust A, so that the dust A is less likely to be collected in the zero-order dust case 114, and also the dust A collected once in the zero-order dust case 114 is liable to scatter again.

Also, in the turnaround type cyclone part 10 as shown in the second embodiment, the discharge port body 15 has a configuration such as to project from the upper portion of the swirl chamber 12. However, since the force for sucking the dust A through the micropores in the side wall of the discharge port body 15 is restrained, even if the zero-order opening 113 is provided at a height close to the discharge port body 15, the dust A can be collected surely in the zero-order dust case 114. Therefore, the depth of the zero-order dust case 114 can be increased, and thereby the dust A is further restrained from scattering again, so that the dust collecting performance can be enhanced.

Also, as shown in FIG. 17, the discharge port body 15 has a configuration such that in the cylindrical mesh 15*b* constituting a part of the side wall of the discharge port body 15, micropores are formed in a zone excluding a part near the inflow port 11, for example, a portion denoted by reference sign 15*d*.

Thereby, the suction air flowing in through the inflow port 11 is restrained from being sucked directly into the discharge port body 15, and the current in the swirl direction is further strengthened to enhance the centrifugal force acting on the dust A, so that the dust collecting performance can be improved further. In contrast, in the case where the micropores are formed in the portion near the inflow port 11, some of the air current is discharged from the discharge port body 15 without being swirled in the swirl chamber 12, and an air current directed toward the direction reverse to the swirl direction is also generated. Therefore, the centrifugal force acting on the dust A decreases, and the dust A is less likely to be collected.

Figure 18:
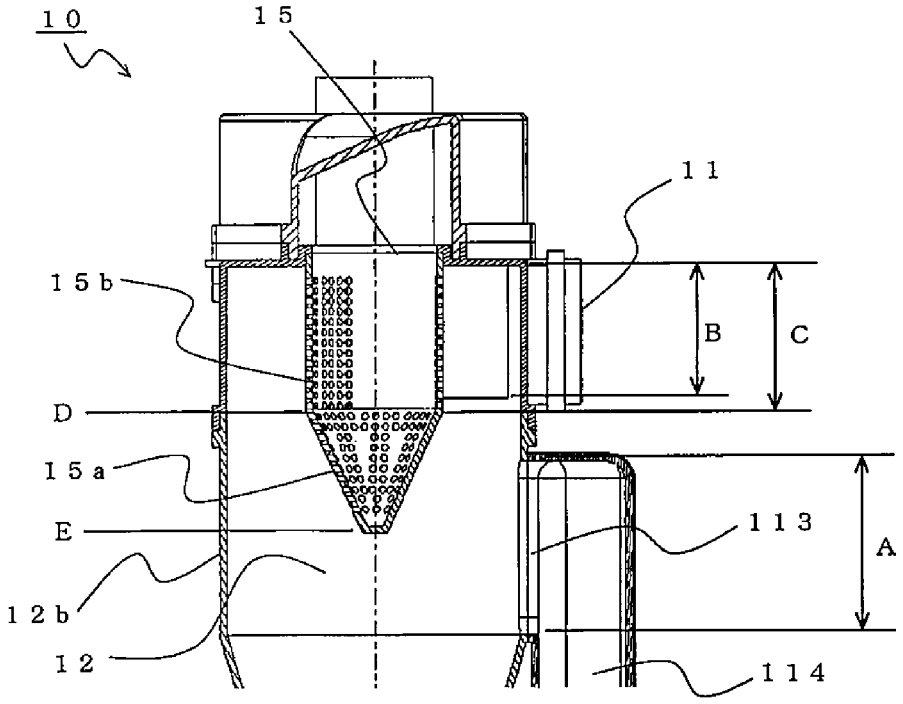
FIG. 18 is a sectional view taken along the line A-A of FIG. 7 in the second embodiment.

FIG. 18 is a sectional view showing the positional relationship in the axial direction between the conical mesh 15*a* and the zero-order opening 113 and the positional relationship in the axial direction between the inflow port 11 and the cylindrical mesh 15*b*. In FIG. 18, A denotes the opening range in the axial direction of the zero-order opening 113, B denotes the height range in the axial direction of the inflow port 11, C denotes the height range in the axial direction of the cylindrical mesh 15*b*, D denotes the height position in the axial direction of the large end of the conical mesh 15*a*, and E denotes the height position in the axial direction of the small end of the cylindrical mesh 15*b*.

As shown in FIG. 18, the conical mesh 15*a* is configured so that the height position in the axial direction of at least a part of the substantially conically-shaped surface of the conical mesh 15*a* comes within the opening range A in the axial direction of the zero-order opening 113.

Thereby, the distance between the zero-order opening 113 and the micropores in the side wall of the discharge port body 15 is secured and the force for sucking the dust A through the micropores in the side wall of the discharge port body 15 is restrained while the suction force in the axial direction is restrained and the swirling force acting on dust is increased, so that the dust A can be collected surely in the zero-order dust case 114. Also, in the turnaround type cyclone part 10 as shown in the second embodiment, the discharge port body 15 has a configuration such as to project from the upper portion of the swirl chamber 12. However, since the force for sucking the dust A through the micropores in the side wall of the discharge port body 15 is restrained, even if the zero-order opening 113 is provided at a height close to the discharge port body 15, the dust A can be collected surely in the zero-order dust case 114. Therefore, the depth of the zero-order dust case 114 can be increased, and thereby the dust A is further restrained from scattering again, so that the dust collecting performance can be enhanced. (This effect is referred to as effect A.)

Also, as shown in FIG. 18, the configuration is made such that the height range B in the axial direction of the inflow port 11 is made within the height range C in the axial direction of the cylindrical mesh 15*b*, and the height position D in the axial direction of the large end of the conical mesh 15*a* is made out of the opening range A in the axial direction of the zero-order opening 113.

Thereby, the air current entering through the inflow port 11 can be swirled smoothly, so that the centrifugal force acting on dust is increased, and thereby the dust collecting performance can be improved. Also, since only the conical mesh 15*a* is arranged in the opening range A in the axial direction of the zero-order opening 113, the distance between the zero-order opening 113 and the micropores in the side wall of the discharge port body 15 can be secured more surely. Therefore, the centrifugal force acting on the dust A is increased, and thereby the dust collecting performance can be enhanced while the force for sucking the dust A, which is driven off into the zero-order dust case 114, through the micropores in the side wall of the discharge port body 15 is restrained.

The relationship between the height positions E and D in the axial direction of the small end and the large end, respectively, of the conical mesh 15*a* and the opening range A in the axial direction of the zero-order opening 113 is not limited to the above-described one.

Figure 19:
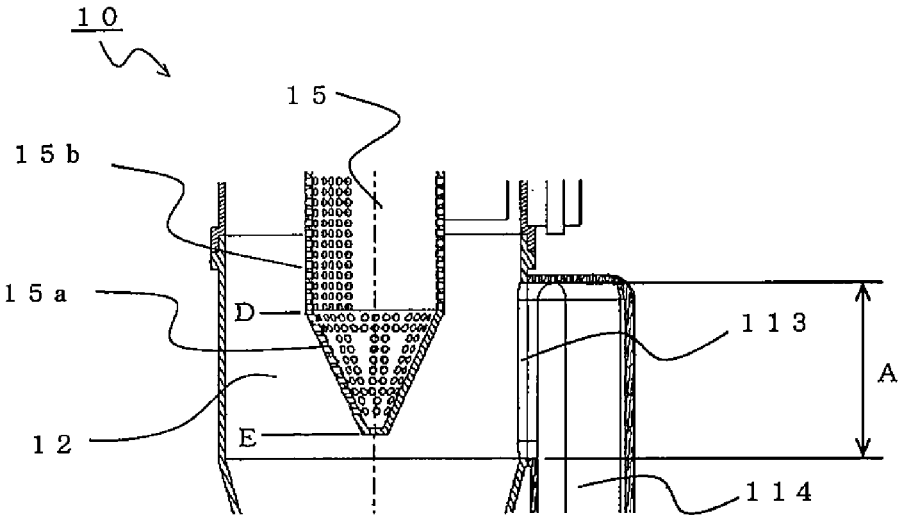
FIG. 19 is a sectional view taken along the line A-A of FIG. 7 in the second embodiment.

For example, as shown in FIG. 19, both the height positions E and D in the axial direction of the small end and the large end, respectively, of the conical mesh 15*a* may come within the opening range A in the axial direction of the zero-order opening 113.

Figure 20:
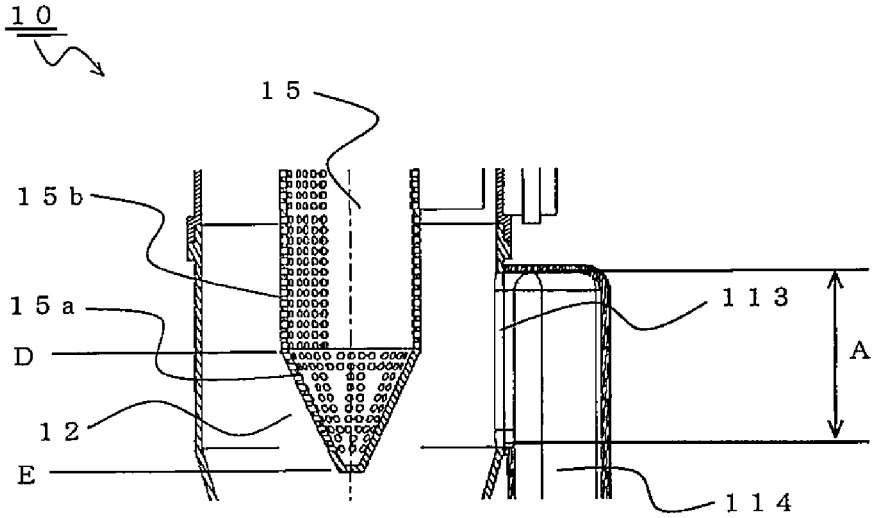
FIG. 20 is a sectional view taken along the line A-A of FIG. 7 in the second embodiment.

Also, as shown in FIG. 20, the configuration may be made such that the height position D in the axial direction of the large end of the conical mesh 15*a* comes within the opening range A in the axial direction of the zero-order opening 113, whereas the height position E in the axial direction of the small end of the conical mesh 15*a* comes out of the opening range A in the axial direction of the zero-order opening 113.

Figure 21:
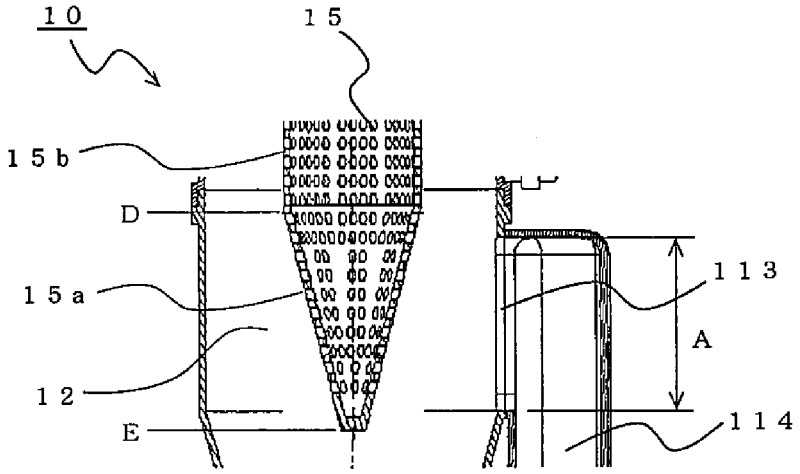
FIG. 21 is a sectional view taken along the line A-A of FIG. 7 in the second embodiment.

Further, as shown in FIG. 21, the configuration may be made such that both the height positions E and D in the axial direction of the small end and the large end, respectively, of the conical mesh 15*a* come out of the opening range A in the axial direction of the zero-order opening 113, and the height position E in the axial direction of the small end of the conical mesh 15*a* is lower than the height position in the axial direction of the lower end of the zero-order opening 113.

That is, if the height position in the axial direction of at least a part of the substantially conically-shaped surface of the conical mesh 15*a* is made within the opening range A in the axial direction of the zero-order opening 113, the distance between the zero-order opening 113 and the micropores in the side wall of the discharge port body 15 can be secured, and the zero-order opening 113 can be arranged at the highest possible position. Therefore, an effect that is the same as the above-described effect A can be achieved.

Figure 22:
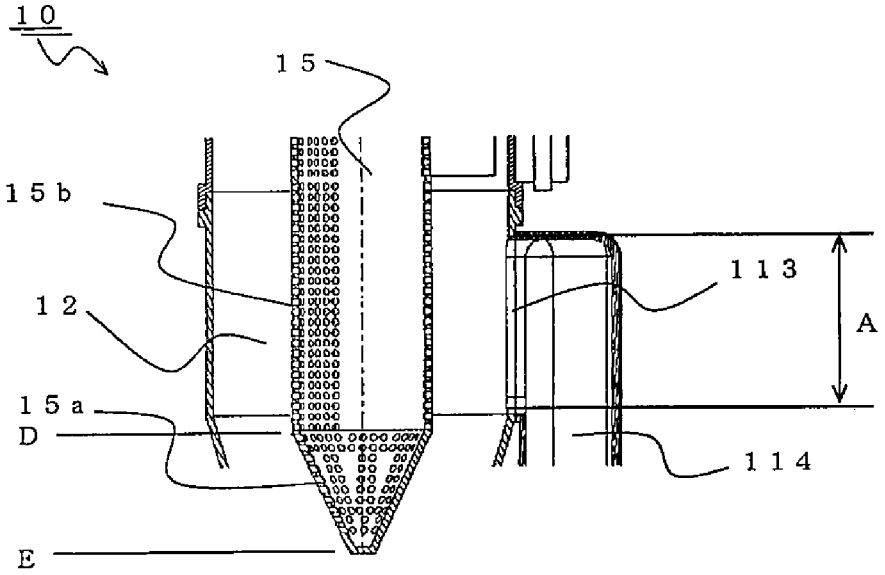
FIG. 22 is a sectional view taken along the line A-A of FIG. 7 not in the second embodiment.
Figure 23:
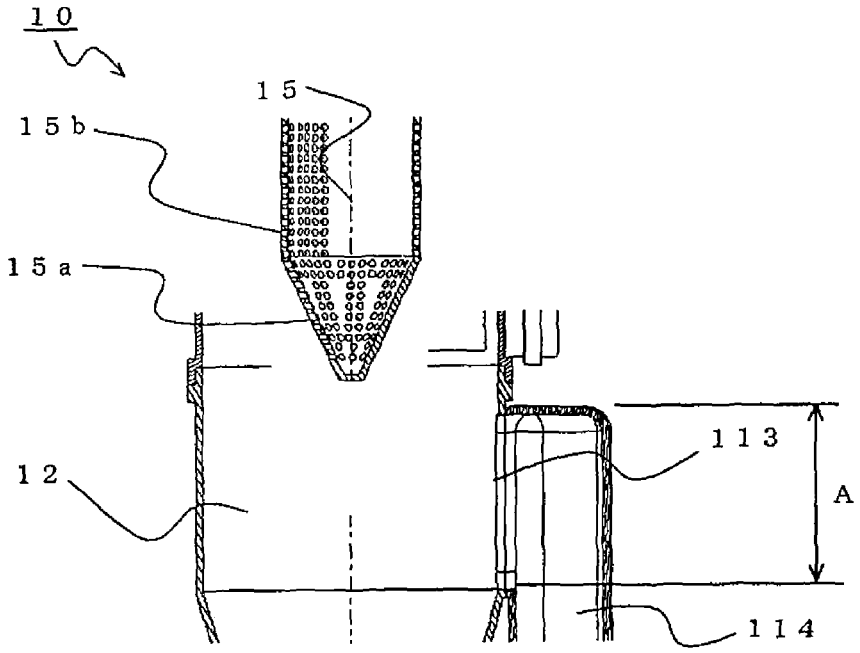
FIG. 23 is a sectional view taken along the line A-A of FIG. 7 not in the second embodiment.

In contrast, in FIG. 22 (comparative example 1), the height position in the axial direction of the substantially conically-shaped surface of the conical mesh 15*a* comes out of the opening range A in the axial direction of the zero-order opening 113, so that the distance between the zero-order opening 113 and the micropores in the side wall of the discharge port body 15 cannot be secured. Also, in FIG. 23 (comparative example 2), the zero-order opening 113 cannot be arranged at a high position. Therefore, the configuration examples of FIGS. 22 and 23 cannot achieve the above-described effect.

In the above-described first and second embodiments, the vacuum cleaner provided with the second cyclone part 20 has been described. However, the vacuum cleaner in accordance with the present invention may be provided with the cyclone part 10 only, or may be provided with a plurality of cyclones (the second cyclone part, a third cyclone part and so on). Also, since the present invention relates to the construction of the cyclone dust collector, the present invention is not limited to the canister-type vacuum cleaner having been explained in the first and second embodiments.

Also, in the above-described first and second embodiments, the micropores in the conical mesh 15*a* and the cylindrical mesh 15*b* have been described as pores for allowing the interior and the exterior of the wall surface having a thickness to communicate with each other. However, the configuration is not limited to this one. For example, the configuration may be such that a mesh filter is stretched on a frame body.

Further, in the first and second embodiments, the sealing structure and locking structure between parts have not been referred to. However, it is desirable that the sealing structure and the locking structure be provided so as not to make the flow of air current turbulent in the cyclone dust collector 50.

Description of Symbols

1 suction port body, 2 suction pipe, 3 connecting pipe, 4 hose, 5 cleaner body, 10 cyclone part, 11 inflow port, 12 swirl chamber, 12*a* conical part, 12*b* cylindrical part, 13 first-order opening, 14 first-order dust case, 15 discharge port body, 15*a* conical mesh, 15*b* cylindrical mesh, 20 second cyclone part, 21 second inflow port, 22 second swirl chamber, 24 second-order dust case, 25 second discharge port, 31 dust case lid, 32 intermediate air passage, 49 suction air passage, 50 cyclone dust collector, 51 discharge air passage, 52 filter, 53 motor-driven blower, 54 discharge port, 55 wheel, 100 vacuum cleaner, 113 zero-order opening, 114 zero-order dust case.

The invention claimed is:

1. A vacuum cleaner comprising:

a suction port body for sucking dust-containing air from the outside;

a motor-driven blower for generating suction air; and a cyclone part which is disposed between the suction port body and the motor-driven blower and is provided with an inflow port, a swirl chamber, and a discharge port body so that the dust-containing air flowing in through the inflow port is swirled in the swirl chamber, and is discharged from the discharge port body after dust has been separated, wherein a side wall of the swirl chamber has:

a substantially cylindrically-shaped cylindrical part connected to the inflow port; and a substantially conically-shaped conical part connected to a lower portion of the cylindrical part, wherein the vertex thereof is located at a lower portion thereof, and a side wall of the discharge port body has:

a substantially cylindrically-shaped cylindrical body covered by an upper portion of the cylindrical part of the swirl chamber and having a plurality of pores; and a substantially conically-shaped conical body having a plurality of pores and being connected to a lower portion of the cylindrical body and covered by the cylindrical part of the swirl chamber, wherein the vertex thereof is located at a position which does not reach the conical part of the swirl chamber in the lower portion of the cylindrical part of the swirl chamber, and the vacuum cleaner further comprises:

a first opening formed by opening a side wall of the cylindrical part of the swirl chamber such that a lower end of the first opening is nearer to the conical part than the inflow port and the cylindrical body are to the conical part;

a second opening formed by opening a part of the conical part of the swirl chamber;

a first dust case communicating with the swirl chamber via the first opening; and a second dust case communicating with the swirl chamber via the second opening.

2. The vacuum cleaner according to claim 1, wherein the sum total of opening areas of the pores in the conical body is smaller than the sum total of opening areas of the pores in the cylindrical body.

3. The vacuum cleaner according to claim 1, wherein the tilt angle of the conical part of the swirl chamber with respect to the central axis thereof is approximately equivalent to or smaller than the tilt angle of the conical body of the discharge port body with respect to the central axis.

4. The vacuum cleaner according to claim 1, wherein the opening area of the second opening is smaller than the opening area of the first opening.

5. The vacuum cleaner according to claim 1, wherein the side wall of the discharge port body is formed with pores in a zone excluding a part near the first opening.

6. The vacuum cleaner according to claim 1, wherein the side wall of the discharge port body is formed with pores in a zone excluding a part near the inflow port.

7. The vacuum cleaner according to claim 1, wherein the height position in the axial direction of at least a part of the substantially conically-shaped surface of the conical body comes within the opening range in the axial direction of the first opening.

8. The vacuum cleaner according to claim 1, wherein the inflow port is arranged so that the height range in the axial direction of the cyclone part comes within the height range in the axial direction of the cylindrical body.

9. The vacuum cleaner according to claim 8, wherein the height position in the axial direction of the large end of the conical body comes out of the opening range in the axial direction of the first opening.

10. The vacuum cleaner according to claim 1, wherein the vacuum cleaner further comprises a second cyclone part which is disposed between the cyclone part and the motor-driven blower to separate dust from the dust-containing air discharged from the discharge port body of the cyclone part and to discharge the air from which dust has been removed.

* * * * *